United States Patent [19]

Hirauchi

[11] Patent Number: 4,548,575

[45] Date of Patent: Oct. 22, 1985

[54] OIL HEATING EQUIPMENT

[75] Inventor: Yukio Hirauchi, Nara, Japan

[73] Assignee: Matsushita Electric Industrial Co. Ltd., Osaka, Japan

[21] Appl. No.: 620,264

[22] Filed: Jun. 13, 1984

[30] Foreign Application Priority Data

Jun. 17, 1983 [JP] Japan ..... 58-109569

[51] Int. Cl.[4] ..... F23D 3/28; F23Q 25/00

[52] U.S. Cl. ..... 431/88; 431/317

[58] Field of Search ..... 431/88, 301, 315, 316, 431/317, 302, 304-308; 126/96

[56] References Cited

U.S. PATENT DOCUMENTS 4,417,870 11/1983 Nakamura et al. ..... 431/88 X
4,486,170 12/1984 Tsukada et al. ..... 431/88 X

FOREIGN PATENT DOCUMENTS 5332 1/1977 Japan .
0142630 11/1979 Japan ..... 431/88
3181 1/1980 Japan .
14948 4/1980 Japan .
16843 4/1981 Japan .
0052709 3/1982 Japan ..... 431/88

*Primary Examiner*—Margaret A. Focarino
*Attorney, Agent, or Firm*—Spencer & Frank

[57] ABSTRACT

An oil heating equipment such as a kerosene stove having a wick adapted to be moved vertically between a raised position where the fire is set thereon and a lowered position where the fire is extinguished. Means are provided for limiting the range of adjustment of the wick height to prevent the wick from coming down below the range optimum for the burning. The equipment has two modes of extinction: namely, an ordinary extinction mode in which the fire can be extinguished gradually to leave no unfavorable smell of unburnt fuel vapor, and an emergency extinction mode in which the fire can be extinguished instantaneously to ensure the safety. The equipment has a limiting mechanism for limiting the manual rotation of the wick driving shaft in the wick lowering direction to a predetermined range, a limit dismissing mechanism for dismissing the limitation imposed by the limiting mechanism, thereby allowing the wick driving shaft to rotate in the wick lowering direction beyond the range, and a stop mechanism which is adapted to stop, when the wick driving shaft is manually rotated after the dismissal of the limit of rotation range, the wick driving shaft at a rotational position aback from the rotational position to which the wick driving shaft is rotated when the wick is lowered quickly by the force of the spring means after the locking means is made inoperative by the operation of the anti-earthquake emergency extinction means.

3 Claims, 11 Drawing Figures

OIL HEATING EQUIPMENT

BACKGROUND OF THE INVENTION

The present invention relates to an oil heating equipment having a wick for sucking up and burning a fuel oil such as kerosene oil thereby heating the air in a room, the wick being adapted to be moved up and down between a fuel burning position where the fire is set on the wick and an extinction position where the fire is extinguished. More particularly, the invention is concerned with an oil heating equipment of the kind described, improved to limit the amount of rotation of the wick driving shaft for ensuring a stable burning of the fuel oil. The invention also aims at providing an oil heating equipment of the type described, wherein the ordinary extinction of the flame by manual rotation of the wick driving shaft can be made smoothly to leave no bad smell and, while, in case of an emergency in which an anti-earthquake device operates, the flame is extinguished in quite a short time to ensure safety.

DESCRIPTION OF THE PRIOR ART

Figure 1:
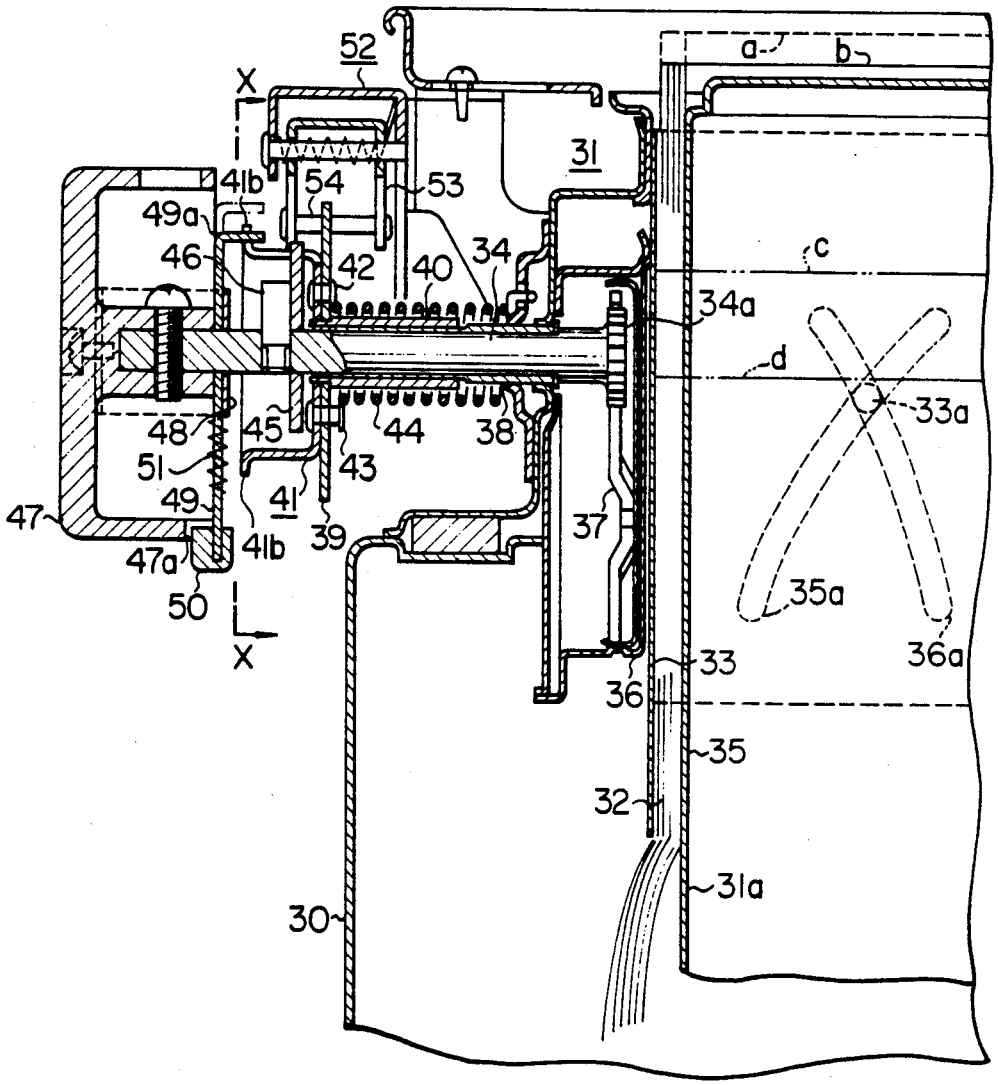
FIG. 1 is a sectional view of an embodiment of the oil heating equipment in accordance with the invention.

Such an oil heating equipment is known as having a wick movable vertically between a fuel burning position and an extinction position. Generally, as shown in FIGS. 4 to 7, this type of oil heating equipment has a burner section 2 mounted on a tank 1. The burner section 2 has a wick 3 which is normally biased downwardly and movable up and down as it is driven by a wick driving shaft 4 through a rack 5 and a pinion 6. A ratchet wheel 9 is fixed to the wick driving shaft 4 through friction members 10 and 11. A support member 8 is fixed to the wick driving shaft 4 and a rotary plate 13 having a pin 14 is secured to the support member 8. The ratchet wheel 9 is provided with an elongated hole 15 for receiving the pin 14. Since the pin 14 is movable only within the angular range limited by the elongated hole 15, the stroke of the vertical movement of the wick 3 is limited thereby optimizing the rate of burning. The tank 1 is provided with an earthquake sensor 16 which is constituted by a weight 17, an extinction knob 23 and a lever 18 which can be operated by either one of the weight 17 and the knob 23. The lever 18 is provided at its free end with a pawl 21 adapted for engagement with the pawl 9' of the ratchet wheel 9 so as to prevent the ratchet wheel 9 from rotating in the direction for lowering the wick. The range of rotation of the ratchet wheel 9 is limited by a protrusion 9'' on the ratchet wheel and is adapted to be stopped by the pawl 21. Therefore, the wick 3 is allowed to move up and down only by an amount corresponding to the range of rotation of the ratchet wheel. A reference numeral 7 designates a knob which is fixed to the wick driving shaft 4.

In operation, as the knob 7 is rotated in one direction, the wick 3 is moved upwardly while storing energy. In this case, the ratchet wheel 9 is rotated together with the ratchet driving shaft 4 through frictional engagement between the friction members 10 and 11. As the knob 7 becomes free of the manual operating force, the pawl 21 comes into the valley between adjacent teeth 9' of the ratchet wheel 9 so that the wick 3 is locked at the instant height. For adjusting the burning rate through changing the wick height, the knob 7 is rotated in the counter direction, so that the wick driving shaft 4 is rotated overcoming the frictional force existing between two frictional members 10 and 11, although the ratchet wheel 9 is prevented from rotating by the pawl 21. Consequently, the wick height and, hence, the burning rate is adjusted within the range limited by the length of the elongated hole 15.

For extinguishing the flame, the extinction knob 23 is operated to swing the lever 18 so as to bring the pawl 21 out of engagement with the teeth 9' of the ratchet wheel 9. Consequently, the ratchet wheel 9 is released to permit the wick 3 to be lowered by the stored energy, so that the flame is extinguished instantaneously. On the other hand, in an emergency case such as an earthquake, any abnormality is sensed by the weight 17 which in turn operates the lever 18. In consequence, the wick is lowered at once to the extinction position to instantaneously extinguish the flame in the same manner as that in the ordinary intentional extinction.

Thus, in the conventional oil heating equipment such as a kerosene stove, the extinction of the flame, regardless of whether it is intentionally made by manual operation or automatically in response to any abnormality, is made instantaneously by a quick lowering of the wick. In general, it is known that a quick extinction of fire tends to generate a large amount of unburnt vapor of fuel oil such as kerosene which leaves an unfavourable smell. Such smell must be accepted in the case of an emergency but, in the case of ordinary extinction in daily use, such a smell should be avoided. Thus, the conventional oil heating equipment has suffered from the disadvantage that the unfavourable smell of unburnt fuel vapor is left at each time of extinction in daily use. This is attributable to the quick lowering of the wick to the bottom position.

Namely, in the conventional oil heating equipment, the lowering of the wick 3 by the manual operation of the knob 7 is only within the range of the elongated hole 15 formed in the ratchet wheel 9, and further lowering of the wick 3 can be made only by the quick extinction mechanism triggered by the extinction knob 23. This is the reason why an unfavourable smell is inevitably left at each time of extinction in the daily use of the conventional oil heating equipment.

It is to be noted also that, in the conventional oil heating equipment, the flame extinction stroke of the wick, i.e., the lowered position of the wick where the flame is extinguished, is constant. In other words, the conventional oil heating equipment is not constructed to allow for the extinction stroke to be varied depending on conditions, i.e., depending on whether the extinction is made intentionally by manual operation or in response to any abnormality in the case of an emergency. The flame extinction stroke is closely related to the length of time taken for the flame to be extinguished. Namely, for shortening the extinction time, it is necessary to increase the extinction stroke of the wick. A too large extinction stroke of the wick, however, causes a strong smell of unburnt fuel oil vapor at each time of extinction. To avoid this problem, hitherto, it has not been considered a good policy to make the extinction stroke so large. Consequently, the extinction time is prolonged disadvantageously. This is quite inconvenient from the view point of safety.

SUMMARY OF THE INVENTION

Accordingly, an object of the invention is to provide an oil heating equipment which can overcome the above-described problems of the prior art.

To this end, according to the invention, there is provided an oil heating equipment comprising: a wick driving shaft; spring means which is adapted to be loaded to such an extent as to be able to lower a wick from a raised position to an extinction position; a ratchet wheel mounted on the wick driving shaft and provided on the periphery thereof with a plurality of teeth; an operative connecting means for operatively connecting the ratchet wheel to the wick driving shaft; a locking means resiliently biased into engagement with a tooth on the ratchet wheel to lock the ratchet wheel, preventing it from rotating in the same direction as the rotation of the wick driving shaft for lowering the wick; and an anti-earthquake emergency extinction means for disengaging the locking means to release the ratchet wheel; wherein the operative connecting means includes a connecting mechanism which permits the ratchet wheel to rotate following the rotation of the wick driving shaft in the wick raising direction but to prevent the ratchet wheel from rotating when the wick driving shaft is rotated in the wick lowering direction, a limiting mechanism for limiting the manual rotation of the wick driving shaft in the wick lowering direction to a predetermined range, a limit dismissing mechanism for dismissing the limitation imposed by the limiting mechanism, thereby allowing the wick driving shaft to rotate in the wick lowering direction beyond that range, and a stop mechanism which is adapted to stop, when the wick driving shaft is manually rotated after the dismissal of the limit of rotation range, the wick driving shaft at a rotational position aback from the rotational position to which the wick driving shaft is rotated when the wick is lowered quickly by the force of the spring means after the locking means is made inoperative by the operation of the anti-earthquake emergency extinction means.

Thus, in the oil heating equipment of the invention, the vertical movement of the wick caused by the rotation of the wick driving shaft is limited to maintain a good state of burning of the fuel oil on the wick. For intentionally extinguishing the flame, the limit dismissing mechanism operates to allow the wick to move further downward to the extinction position. This extinction position is above the emergency extinction position to which the wick is lowered when the anti-earthquake extinction device operates in response to abnormality. According to this arrangement, the extinction time can be prolonged when the extinction is made intentionally through manual rotation of the wick driving shaft, so that the generation of unfavourable smell is suppressed advantageously, while the extinction in the case of emergency can be made in quite a short time to ensure the safety.

The above and other objects, features and advantages of the invention will become clear from the following description of the preferred embodiment taken in conjunction with the accompanying drawings.

DESCRIPTION OF THE PREFERRED EMBODIMENT

Figure 2A:
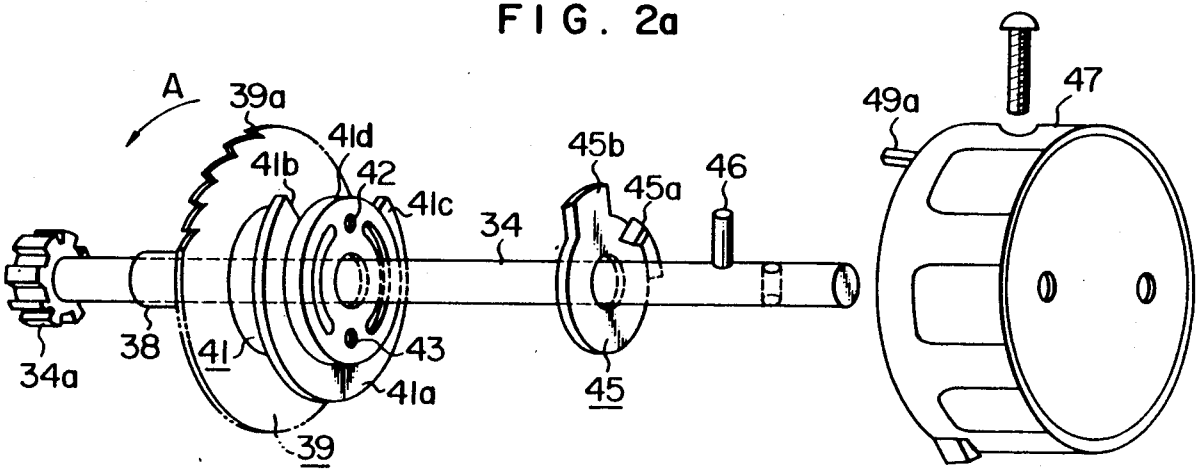
FIG. 2*a* is an exploded perspective view of an essential part of the embodiment shown in FIG. 1.
Figure 2B:
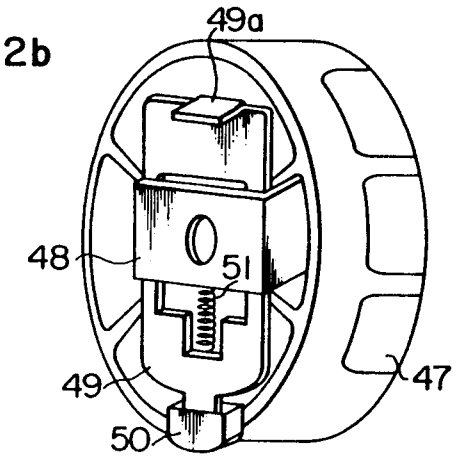
FIG. 2*b* is a perspective view of a knob.

Referring to FIGS. 1 and 2*a*, an oil heating equipment embodying the invention, such as, for example, a kerosene stove, has a fuel tank 30 carrying a burner section 31. The burner section 31 has a wick 32 secured thereto by means of a wick holder 33. The wick 32 is adapted to be moved up and down through an annular gap formed between the wick holder 33 and a wick guide sleeve 31*a*. A wick driving shaft 34 is provided at its end with a pinion 34*a*. An inner cylinder 35 and an outer cylinder 36, which cooperate with each other in driving the wick 32 up and down, are provided with oblique slots 35*a* and 36*a* which receive a pin 33*a* projected from the wick holder 33. The outer cylinder 36 is provided on the periphery thereof with a rack 37 which meshes with the pinion 34*a* mentioned above. The wick driving shaft 34 is rotatably supported by a bearing 38 provided in the burner section 31. A ratchet wheel 39 rotatably carried by the wick driving shaft 34 has a hub 40. As will be best seen from FIG. 2*a*, a cam member 41 is attached to the ratchet wheel 39 by means of rivets 42,43. The cam member 41 is provided on the periphery thereof with a tubular cam portion 41*a* which has a notch 41*d*. The cam portion 41*a* has such a cam contour that the radial length from the axis of the wick drive shaft 34 is gradually decreased from one end 41*c* to the other end 41*b* of the notch 41*d*. A reference numeral 44 designates a flame extinction spring fitted around the hub 40 of the ratchet wheel 39. This extinction spring 44 is preloaded and retained at its one end by a stationary part of the burner section 31 while the other end is held by one 43 of the rivets. A rotary plate 45 is rotatably carried by the wick driving shaft 34. This rotary plate has a bent portion 45*a* and a projection 45*b*, and is disposed such that the projection 45*b* is positioned in the notch 41*d* of the cam portion 41*a*. Thus, the rotary plate 45 is rotatable within the range afforded by the notch 41*d*. A pin 46 is embedded in the wick driving shaft so as to be able to contact the rotary plate 45. The axial biasing force produced by the extinction spring 44 acts to press the pin 46, rotary plate 45 and the cam member 41 one on another. More specifically, as shown in FIGS. 3*a* to 3*d*, the loaded extinction spring 44 acts to bias these three members rotationally in the direction of the arrow A in FIGS. 2 and 3*a*, so that the smaller end 41*c* of the cam member 41 engages with the projection 45*b* of the rotary plate 45 which in turn engages at its bent portion 45*a* thereof with the pin 46, thereby to rotate the wick driving shaft 34 in the wick lowering direction, i.e. in the direction of the arrow A.

A reference numeral 47 denotes a knob which is secured to the wick driving shaft 34 by means of a screw. A guide plate 48 is provided on the inner end surface of the knob 47, with a stop lever 49 slidably interposed therebetween. The stop lever is provided at its one end with a stop portion 49*a* bent towards the cam member 41 so as to engage with the notch 41*d* of the cam member 41, while the other end has a button 50 which projects through a notch 47*a* formed in the knob 47. A compression spring 51 loaded between the stop lever 49 and the guide plate 48 acts to bias the stop lever 49 towards the button 50 so as to keep the stop portion 49*a* in engagement with the cam portion 41*a* of the cam member 41. In the state in which the stop lever 49 is biased by the compression spring 51, the stop portion 49*a* is disposed at the radially inner side of the larger end 41*b* of the cam portion 41*a* but at the radially inner side of the cam portion 41*a*. When the button 50 is pressed, the stop lever 49 is moved against the biasing force of the spring 51, so that the stop portion 49*a* is disposed at the radially outer side of the larger end 41*b* of the cam member 41.

Figure 3A:
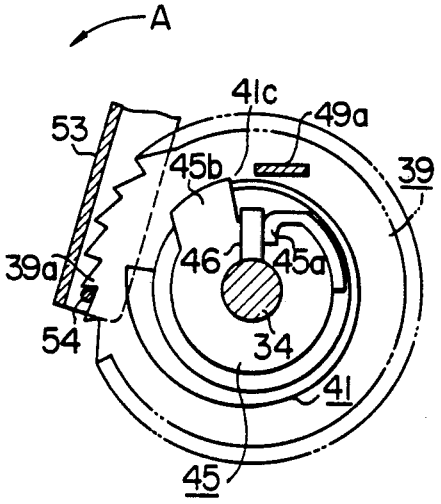
FIG. 3*a* is a sectional view taken along the line III—III of FIG. 1, showing the equipment in the state of operation at the maximum burning rate.

An earthquake sensor 52 attached to a portion of the burner section 31 has a lever 53 which is actuated by a weight (not shown) sensitive to oscillation. As shown in FIG. 3*a*, the lever 53 is provided at its end with a pawl pin 54 for engagement with the teeth 39*a* of the ratchet wheel 39. The pawl pin 54, when engaging with a tooth 39*a*, prevents the ratchet wheel from rotating in the wick lowering direction.

In the arrangement described above, when the knob 47 is rotated in the wick raising direction, the ratchet wheel 39 is rotated through the operation of the wick driving shaft 34, pin 46, rotary plate 45 and the cam member 41, so that the extinction spring 44 is loaded. At the same time, the rack 37 is driven by the pinion 34*a* so that the outer cylinder 36 integral with the rack 37 is rotated. Consequently, the driving pin 33*a* is moved upwardly due to the cam action of the crossing slots 35*a*,36*a* thereby to lift the wick holder 33 and, hence, the wick 32. When the driving pin 33*a* has reached the top of the crossing slots 35*a*,36*a*, the upward movement of the wick 32 is stopped and the pawl pin 54 of the earthquake sensor comes into engagement with a tooth 39*a* of the ratchet wheel 39 to lock the wick 32 at this raised position. In this state, the wick takes the highest position shown by (a) in FIG. 1 and allows the burning of the fuel oil at the maximum burning rate. Meanwhile, the stop lever 49 rotates together with the knob 47 so that the stop portion 49*a* is located on the outer periphery of the smaller end 41*c* of the cam member 41. The positional relationship of these members in the circumferential direction is shown in FIG. 3*a*. Namely, the pin 46 is held in engagement with the bent portion 45*a* of the rotary member 45, while the projection 45*b* is held in engagement with the smaller end 41*c* of the cam member 41.

Figure 3B:
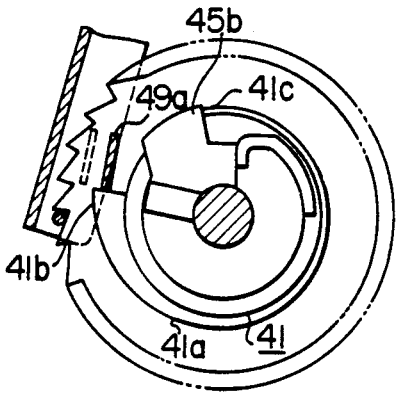
FIG. 3*b* is a sectional view taken along the line III—III of FIG. 1, showing the equipment in the state of operation at the minimum burning rate.
Figure 3C:
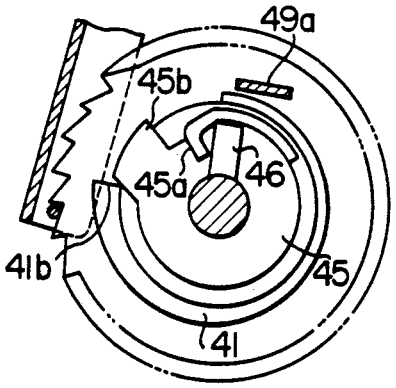
FIG. 3*c* is a sectional view taken along the line III—III of FIG. 1 showing the equipment in the state of extinction of flame by manual operation.
Figure 3D:
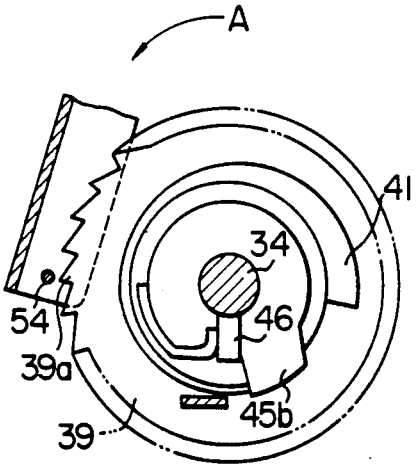
FIG. 3*d* is a sectional view taken along the line III—III of FIG. 1, showing the equipment in the state of emergency fire extinction.
Figure 4:
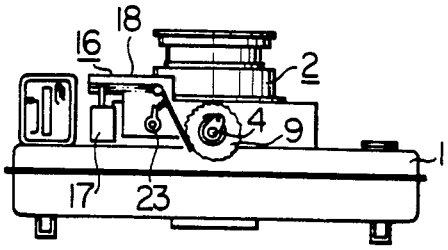
FIG. 4 (PRIOR ART)
FIG. 4 is a side elevational view of a conventional oil heating equipment.
Figure 5:
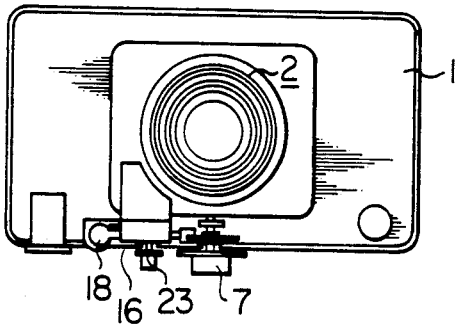
FIG. 5 (PRIOR ART)
FIG. 5 is a plan view of the oil heating equipment shown in FIG. 4.
Figure 6:
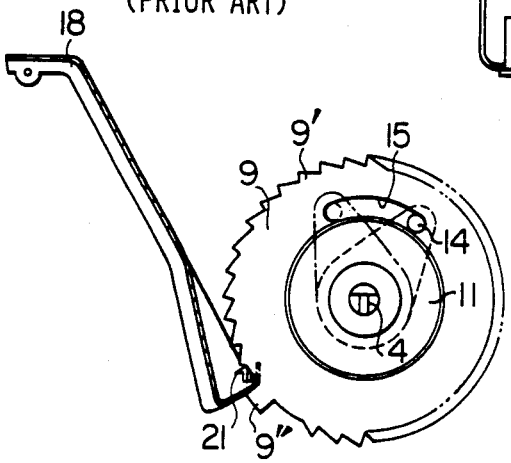
FIG. 6 (PRIOR ART)
FIG. 6 is a front elevational view of an essential part of the conventional oil heating equipment shown in FIG. 4.
Figure 7:
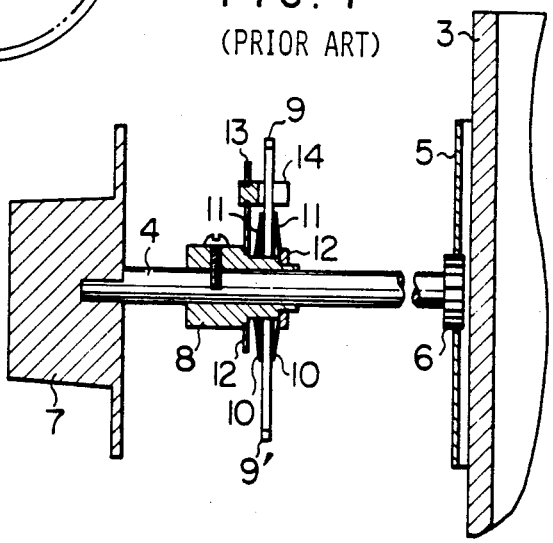
FIG. 7 (PRIOR ART)
FIG. 7 is a sectional view of the essential part.

For lowering the wick 32 by lowering the state of burning, the knob 7 is rotated in the wick lowering direction (arrow A), so that the stop lever 49 is rotated until the stop portion 49*a* thereof comes into engagement with the larger end 41*b* of the cam member 41 as shown in FIG. 3*b*. In this state, the wick takes a position indicated by (b) in FIG. 1. Thus, the height of the wick 32 is adjustable within the range of between the maximum height indicated by (a) and the minimum height indicated by (b). Since this range is selected so as not to impair the state of burning, problems such as imperfect burning cannot be experienced even when the wick 32 is lowered to the minimum height.

For further lowering the wick 32, the stop button 50 is pushed to move the stop lever 49 against the force of the compression spring 51, thereby to move the stop portion 49*a* to the radially outer side of the larger end 41*b* of the cam member 41. In this state, the knob 47 is allowed to rotate freely so that the pin 46 engages with the inner side of the bent portion 45*a* of the rotary plate 45. In addition, the rotary plate 45 rotates until it contacts the larger end 41*b* of the cam member 41. In this state, the rotary plate 45 has been rotated about 360° from its position when the wick is at its maximum height. When the rotary plate is stopped, the wick 32 takes the position as shown by (c) in FIG. 1. This position (c) has been selected to assure extinction within a time, e.g., 300 seconds, which is considered as being generally acceptable for ordinary oil heating equipment from the view point of safety. The wick position (c) will be referred to as "first extinction position", hereinunder.

Thus, in the ordinary case, the wick is moved between the maximum burning position (a) and the first extinction position (c). For lighting the wick, the knob 47 is rotated in the wick raising direction to raise the wick 32 to the maximum burning position where it is lit by a suitable means so that the fuel oil is burnt in a burning sleeve (not shown) mounted on the burning section 31. Then, for optimizing the burning rate, the height of the wick 32 is adjusted within the range between the positions (a) and (b) as desired. For extinguishing the flame, the user rotates the knob 47 in the wick lowering direction while pressing the stop lever 49, so that the wick 32 is lowered to the first extinction position (c) to gradually extinguish the flame.

For restarting the oil heating equipment, the knob 47 is rotated in the wick raising position so that the stop lever 49 attached to the knob 47 is rotated as a unit therewith. Meanwhile, the stop portion 49*a* of the stop lever 49 slides along the cam contour of the cam portion 41*a* of the cam member 41 because it is pressed against the cam member by the force of the stop spring 51. When the stop portion 49*a* is moved beyond the larger end 41, it is moved radially inwardly by the force of the stop spring 51 to take the position shown in FIG. 3*a*. Then, as the knob 7 is rotated in the wick lowering direction to optimize the burning rate, the stop portion 49*a* comes into engagement with the larger end 41*b* to prevent further rotation of the stop lever 49*a* and, hence, the rotation of the knob 47 integral with the stop lever.

On the other hand, in the case of an emergency such as oscillation or vibration of the oil heating equipment due to, for example, an earthquake or an accidental turning of the oil heating equipment sideways, the earthquake sensor 52 operates to disengage the pawl pin 59 from the tooth 39*a* of the ratchet wheel 39 to allow the loaded extinction spring 44 to rotate the ratchet wheel 39 in the wick lowering direction indicated by the arrow A. This force is transmitted to the wick driving shaft 34 through the cam member 41, rotary plate 45 and the pin 46, thereby instantaneously lowering the wick 32. In this state, the knob 47 fixed to the wick driving shaft 34 is rotated as a unit therewith and also with the stop lever 49 secured to the knob 47. Thus, the mechanism for limiting the range of adjustment of the wick height, constituted by the cam member 41 and the stop lever 49, is also rotated together with the ratchet wheel 39. The angle of rotation in this emergency case is about 540° which is greater than that (about 360°) attained when the knob 47 is rotated manually for intentional extinction of the flame. Therefore, the wick in this case is lowered to a position (d) referred to as a "second extinction position" below the first extinction position. Consequently, the flame is extinguished instantaneously to prevent accident such as a fire which may otherwise occur due to earthquake or similar abnormal condition.

The extinction of the flame in the ordinary state is effected by lowering the wick to the first extinction position which is above the second extinction position to which the wick is lowered in the case of an emergency. The extinction at the first extinction position takes a longer time than the emergency extinction. However, since the small fire remains to burn up the unburnt fuel gas in the upper portion of the wick, no bad smell of fuel is left after the extinction. In contrast, the emergency fire extinction at the second extinction position permits an almost instantaneous extinction, although a bad smell is inevitably produced.

In the embodiment described hereinunder, the emergency extinction is effected only automatically upon detection of oscillation or impact, through the operation of a weight which activates the lever 53 to move the pawl pin 54 out of engagement with the tooth 39*a* of the ratchet wheel 39. This arrangement, however, is not exclusive and the means for the emergency extinction may also be operated manually by a suitable mechanism which permits the user to disengage the pawl pin 54 from the ratchet wheel 39. In such a case, in the event that the user becomes aware of any abnormality such as imperfect burning, he can immediately extinguish the fire by lowering the wick to the second extinction position by a manual operation.

As will be understood from the foregoing description, the present invention offers the following advantages.

Namely, the imperfect burning of the fuel, which may occur when the wick is lowered below the range for optimum burning, is avoided thanks to the provision of the mechanism for limiting the wick height to a predetermined range for optimum burning.

It is to be noted also that, since two modes of extinction, i.e., the ordinary extinction at the first extinction position and the emergency extinction at the second extinction position below the first one, are available, it is possible to avoid the generation of an unfavourable smell of unburnt fuel vapor in an ordinary extinction while ensuring the quick extinction in the case of an emergency.

What is claimed is:

1. An oil heating equipment comprising: a wick driving shaft; spring means which is adapted to be loaded to such an extent as to be able to lower a wick from a raised position to an extinction position; a ratchet wheel mounted on the wick driving shaft and provided on the periphery thereof with a plurality of teeth; an operative connecting means for operatively connecting said ratchet wheel to said wick driving shaft; a locking means resiliently biased into engagement with a tooth on said ratchet wheel to lock said ratchet wheel from rotating in the same direction as the rotation of said wick driving shaft for lowering the wick; and an anti-earthquake emergency extinction means for disengaging said locking means to release said ratchet wheel; wherein said operative connecting means includes a connecting mechanism which permits said ratchet wheel to rotate following the rotation of said wick driving shaft in the wick raising direction but to prevent said ratchet wheel from rotating when said wick driving shaft is rotated in the wick lowering direction, a limiting mechanism for limiting the manual rotation of said wick driving shaft in the wick lowering direction to a predetermined range, a limit dismissing mechanism for dismissing the limitation imposed by said limiting mechanism, thereby allowing said wick driving shaft to rotate in the wick lowering direction beyond said range, and a stop mechanism which is adapted to stop, when said wick driving shaft is manually rotated after the dismissal of the limit of rotation range, said wick driving shaft at a rotational position aback from the rotational position to which said wick driving shaft is rotated when said wick is lowered quickly by the force of said spring means after said locking means is made inoperative by the operation of said anti-earthquake emergency extinction means.

2. An oil heating equipment according to claim 1, wherein said stop mechanism includes a notched cam member provided on said ratchet wheel, a rotary plate carried by said wick driving shaft for free rotation within a range afforded by the notch in said cam member, and a pin fixed to said wick driving shaft so as to be engageable with a bent portion of said rotary plate.

3. An oil heating equipment according to claim 1, wherein said limiting mechanism includes a notched cam member provided on said ratchet wheel and a stop lever provided on said wick driving shaft so as to be engageable with the notch in said cam member, while said limit dismissing mechanism is displaceably mounted so as to be able to disengage said stop lever from said notch in the cam member.

* * * * *